US005431135A

United States Patent [19]

Tyler

[11] Patent Number: 5,431,135

[45] Date of Patent: Jul. 11, 1995

[54] STARTER ASSEMBLY

[75] Inventor: Rex A. Tyler, Lexington, Tenn.

[73] Assignee: Eaton Stamping Company, Eaton Rapids, Mich.

[21] Appl. No.: 234,845

[22] Filed: Apr. 28, 1994

[51] Int. Cl.[6] ..... F02N 3/02

[52] U.S. Cl. ..... 123/185.3; 74/7 C

[58] Field of Search ..... 123/185.3, 185.2, 185.4; 74/7 C; 192/42

[56] References Cited

U.S. PATENT DOCUMENTS

| | | | |
|---|---|---|---|
| 3,081,760 | 3/1963 | Hamman | 123/179 |
| 3,127,884 | 4/1964 | Rice | 123/185 |
| 3,570,464 | 3/1971 | Morabit et al. | 123/185 |
| 3,782,355 | 1/1974 | Hamman | 123/185 B |
| 4,127,098 | 11/1978 | Frers et al. | 123/185 BA |
| 4,480,605 | 11/1984 | Bloemers | 123/185 BA |
| 4,492,190 | 1/1985 | Greenword et al. | 123/185 A |
| 4,637,360 | 1/1987 | Osakabe | 123/185 A |
| 4,970,998 | 11/1990 | Tyler | 123/185 B |
| 5,067,451 | 11/1991 | Tyler | 123/185 BA |

*Primary Examiner*—Andrew M. Dolinar
*Attorney, Agent, or Firm*—Lorusso & Loud

[57] ABSTRACT

A starter assembly comprising a housing, a pulley rotatably mounted in the housing and having pivotally mounted therein pawls for engagement with a coupling that turns an engine. A brake assembly portion of the starter includes a molded plastics retainer including a base portion, legs extending from the base portion, and protrusions extending from the base portion and engageable by the pulley pawls to cause the retainer to rotate with the pulley. The legs of the retainer are disposed in a central opening of a pulley center shaft and are biased radially outwardly to engage the interior of the center shaft to restrain rotation of the retainer. The assembly further includes turning means by which an operator causes rotation of the pulley.

13 Claims, 10 Drawing Sheets

STARTER ASSEMBLY

BACKGROUND OF THE INVENTION

1. Field of the Invention

The invention relates to starters for engines and generators, and is directed more particularly to starters of the type commonly used on lawn mowers, chain saws, snow blowers, marine outboard engines, and the like, wherein motors with 3½–8 horse power typically are used.

2. Description of the Prior Art

It is known to provide starting devices for internal combustion engines, which devices are provided with a rope pulley which rotates as a coiled rope is pulled, and which is rotatably mounted on a stationary central shaft. The shaft is engaged by a retainer spring, or by a spring-biased retainer member, such that a frictional connection prevails between the retainer member and the shaft. The frictional connection causes pawls on the pulley to swivel radially outwardly from the central shaft axis when the pulley is rotated in the starting direction. Free ends of the pawls engage with inner teeth of a coupling which is connected with the crankshaft of the internal combustion engine and which is coaxial with the central shaft. The pawls drive the coupling to start the engine. Upon completion of the rope-pulling stroke, the starter recoils and the pawls retract.

Referring to FIGS. 1 and 2, it will be seen that a prior art starter of the type herein disclosed includes a circular metal housing 10 having an open side 12 and a substantially closed side 14. Centrally of the closed side 14 is an opening 16 in which is disposed a metal tubular center shaft 18. Rotatably mounted on the shaft 18 is a pulley 20 of a plastic material. The pulley 20 is provided with a peripheral trough 22 in which is wound a rope 24. The pulley 20 includes a hub portion 26 provided with a central recess 28 and two bores 30 outboard from, and on opposite sides of the central recess 28. In each of the bores 30 there is disposed a coil spring 32 and base portion 34 of a pawl 36. The pawl base portions 34 are adapted to rotate in the bores 30, such that the pawls 36 may pivot outwardly and inwardly of the pulley hub portion 26.

Referring to FIGS. 3–6, it will be seen that a brake assembly 40, having resistance to rotation, includes a retainer 42 having a central hub portion 44 complementary to the central recess 28 which is adapted to retain the hub portion 44. Extending from the retainer 42 are two protrusions 46 which are positioned so as to be engaged by the pawls 36. Disposed between a floor 48 of the pulley hub portion central recess 28 and an exterior wall 50 (FIG. 4) of the retainer hub portion 44 is a washer 52 having surfaces of a selected coefficient of friction. The retainer wall 50 is provided with a central opening 54. Disposed in the retainer hub portion 44 is a first end 56 of a brake coil spring 58, a second end 60 of the spring 58 having thereon a metal washer 62. A split pin 64 having a flared end 66 extends through the washer 62, the spring 58, and the retainer 42, and is press fitted into the center shaft 18. The coil spring 58 is compressed between the washer 62 and the retainer 42, urging the retainer wall 50 into firm engagement with the friction washer 52.

In operation, an operator pulls the rope 24, which extends through the housing 10. As the rope 24 is pulled outwardly, the pulley 20 is caused to rotate on the center shaft 18. The brake assembly 40, including the retainer 42, initially remains stationary because of the frictional engagement of the retainer 42, the friction washer 52, and the central shaft 18. The retainer hub portion 44 is pressed by the spring 58 into engagement with the stationary friction washer 52, and therefore resists turning. As the pulley hub portion 26 rotates, the moving pawls 36 engage the retainer protrusions 46, pivoting the pawls outwardly, causing the retainer 42 to rotate with the pulley hub portion 26. The free ends of the pawls extend well beyond the pulley hub portion 26 and the retainer 42 (FIG. 3). The resistance to turning of the retainer 42 is not so strong as to prevent turning, but merely places on the retainer 42 sufficient resistance so that the pawls 36 may firmly engage the retainer protrusions 46. Rotation of the hub portion 26 is transmitted by the pawls 36 to a coupling (not shown) that turns an engine crankshaft (not shown).

As may be seen in FIGS. 1–7, the prior art device over which the invention herein constitutes an improvement, includes a multi-component brake assembly which includes a central pin requiring press-fitting. It would be advantageous to reduce the number of parts of the brake assembly and to provide a brake assembly which can be connected to the remainder of the starter without the use of special tools.

Further, the metal pawls of the prior art device shown in FIGS. 1–7 often rattle against the metal retainer, raising a noise problem in the use of the starter.

Still further, in the prior art starter, to change the frictional load resisting rotation of the pulley, one may change the coefficient of friction of the friction washer and/or change the brake spring. Each affects the other and the changes must be accurately coordinated. In practice, changes usually are effected by simply packing the brake assembly with a special grease. It would be beneficial to be able to change the frictional load by a single change in the brake assembly and to not have to introduce special greases.

SUMMARY OF THE INVENTION

An object of the present invention is, therefore, to provide a starter of the type described above, but having a brake assembly comprising in most instances only one part, and in special applications an additional one or two parts easily added to the first part.

A further object of the invention is to provide such a starter wherein the metal pawls engage plastic retainer portions, rather than metal portions, thereby reducing noise levels of operation.

A still further object of the invention is to provide such a starter wherein the frictional characteristics of the brake assembly are easily changed and wherein special greases are not required.

With the above and other objects in view, as will hereinafter appear, a feature of the present invention is the provision of an engine starter assembly comprising a housing, a tubular center shaft fixed in a central opening in the housing, the center shaft having an annular flange therein, and a pulley rotatably mounted on the central shaft. The pulley is provided with a central hub portion, and pawls are each pivotably mounted at one end on the pulley hub portion. A retainer is mounted on the hub portion, the retainer comprising a base portion, legs extending from the base portion, and protrusions extending from the base portion toward the pulley hub portion. The protrusions are engageable by the pawls upon rotation of the pulley, to cause the retainer to rotate with the pulley hub. The legs of the retainer are biased radially outwardly to exercise engagement with interior walls of the tubular center shaft, the engagement being operative to restrain the retainer from rotating freely about the center shaft. The assembly further includes turning means for rotating the pulley.

In accordance with a further feature of the invention, the retainer is of a plastics material, to limit noise when engaged by the pawls.

In accordance with a further feature of the invention the plastics material for the retainer is selected for its coefficient of friction, such that the retainer, when molded, exhibits a selected frictional characteristic.

In accordance with a further feature of the invention, the assembly is provided with a leaf spring, the legs of the retainer being urged outwardly by the leaf spring disposed therebetween.

In accordance with a still further feature of the invention, the assembly is provided with a lock ring disposed in grooves on the interior surfaces of the retainer legs, to prevent the legs from moving inwardly.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative prior art and illustrative embodiments of the invention, from which its novel features and advantages will be apparent.

In the drawings.

DESCRIPTION OF THE PREFERRED EMBODIMENT

Figure 1:
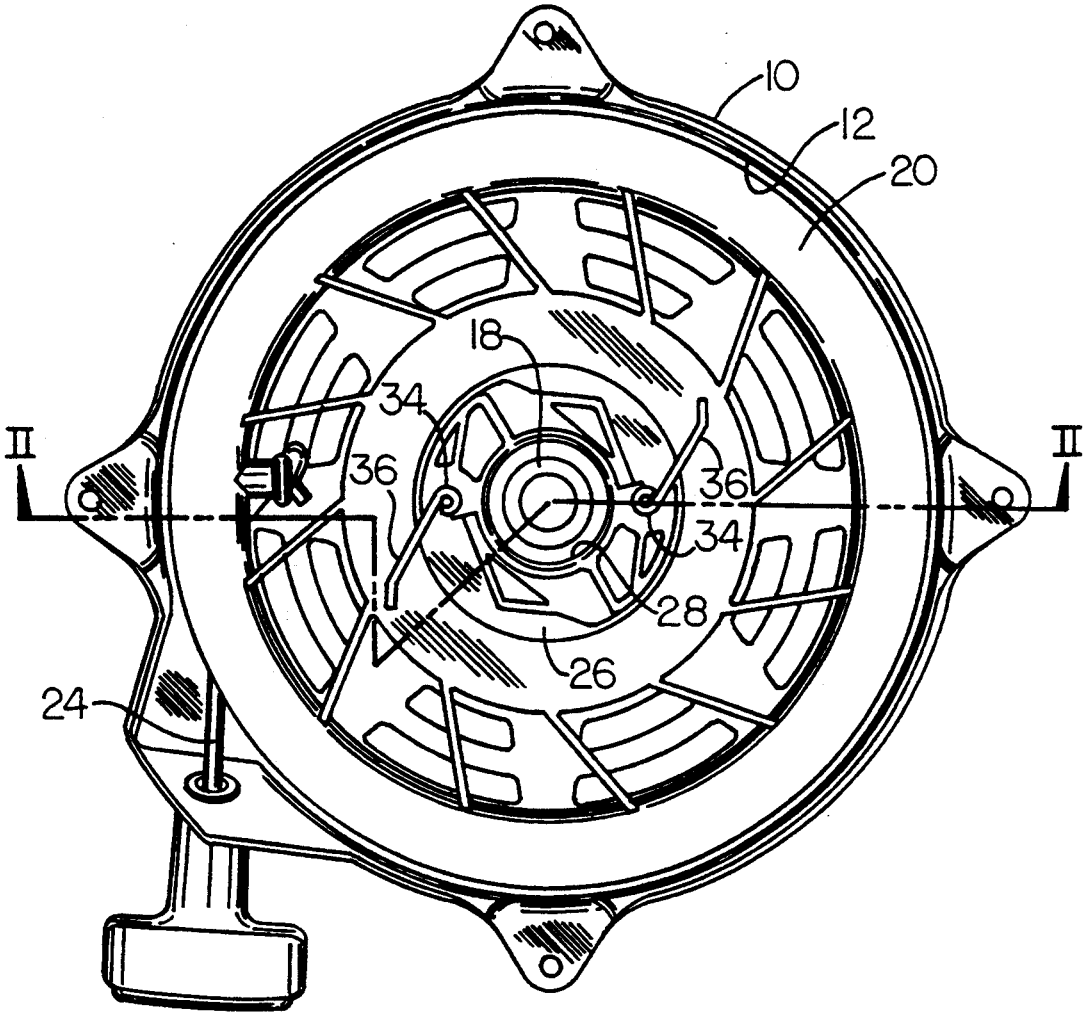
FIG. 1 PRIOR ART
FIG. 1 is a top plan view of housing and pulley portions of a prior art starter.
Figure 2:
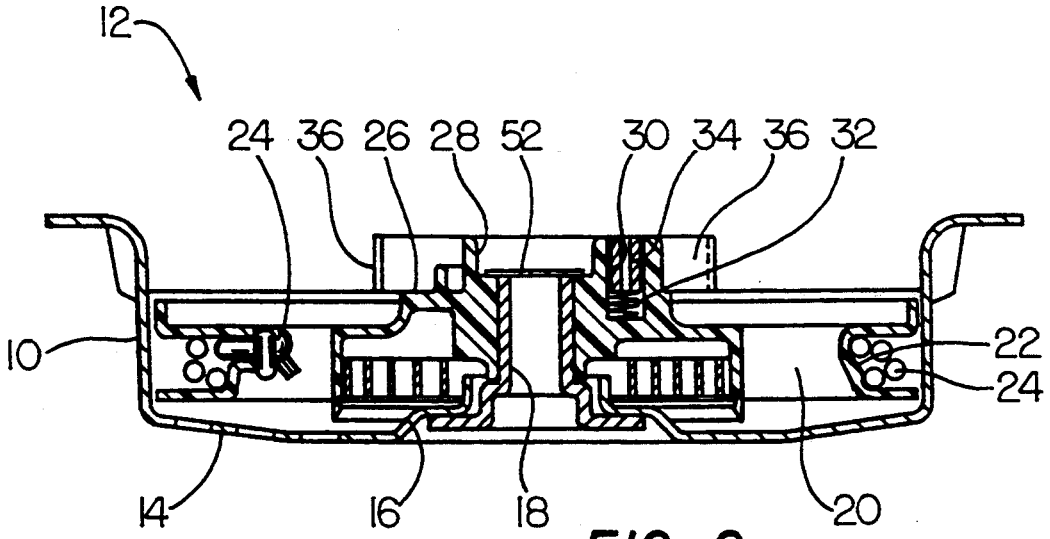
FIG. 2 PRIOR ART
FIG. 2 is a sectional view taken along line II—II of FIG. 1 and showing the friction washer.
Figure 3:
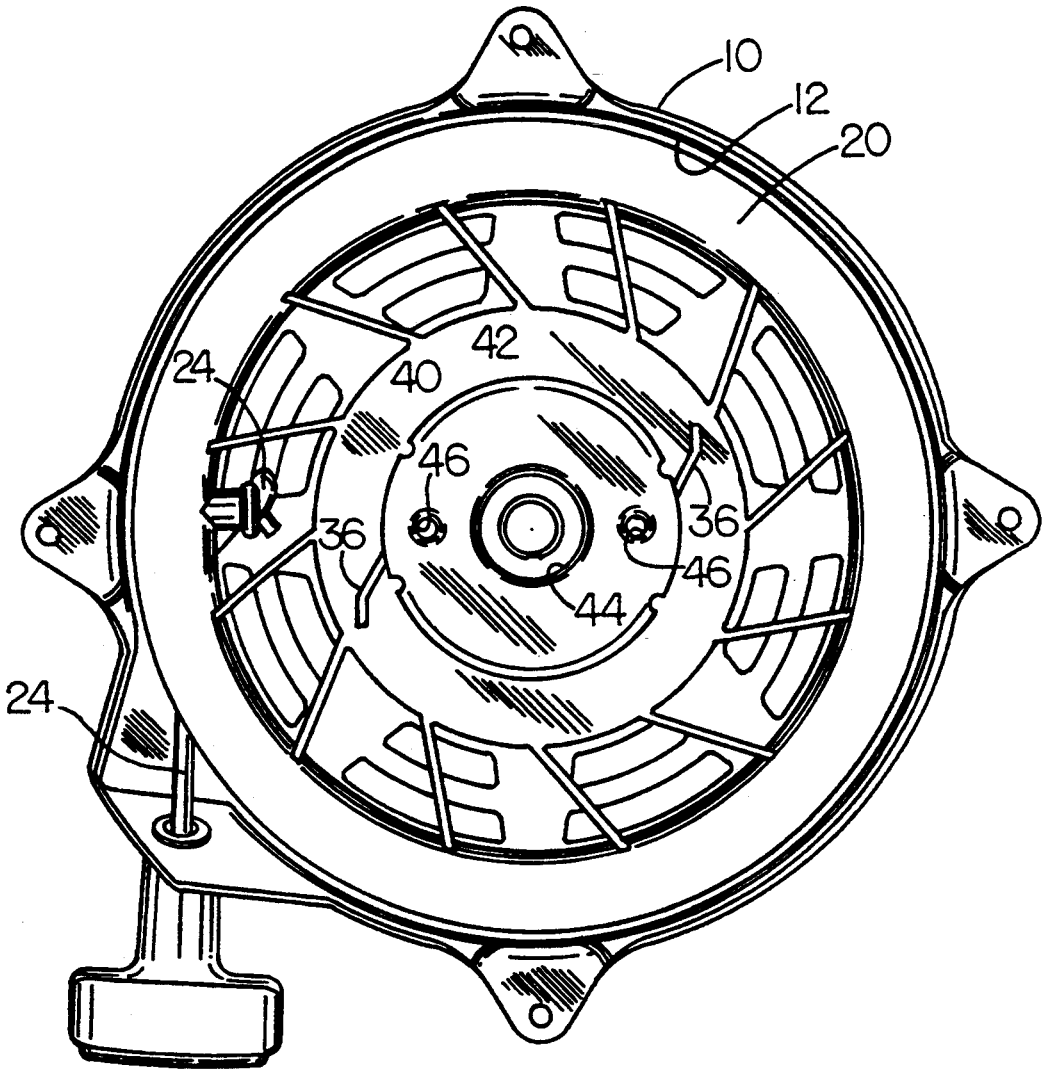
FIG. 3 PRIOR ART
FIG. 3 is a top plan view of the starter of FIGS. 1 and 2 with a prior art brake assembly attached thereto.
Figure 4:
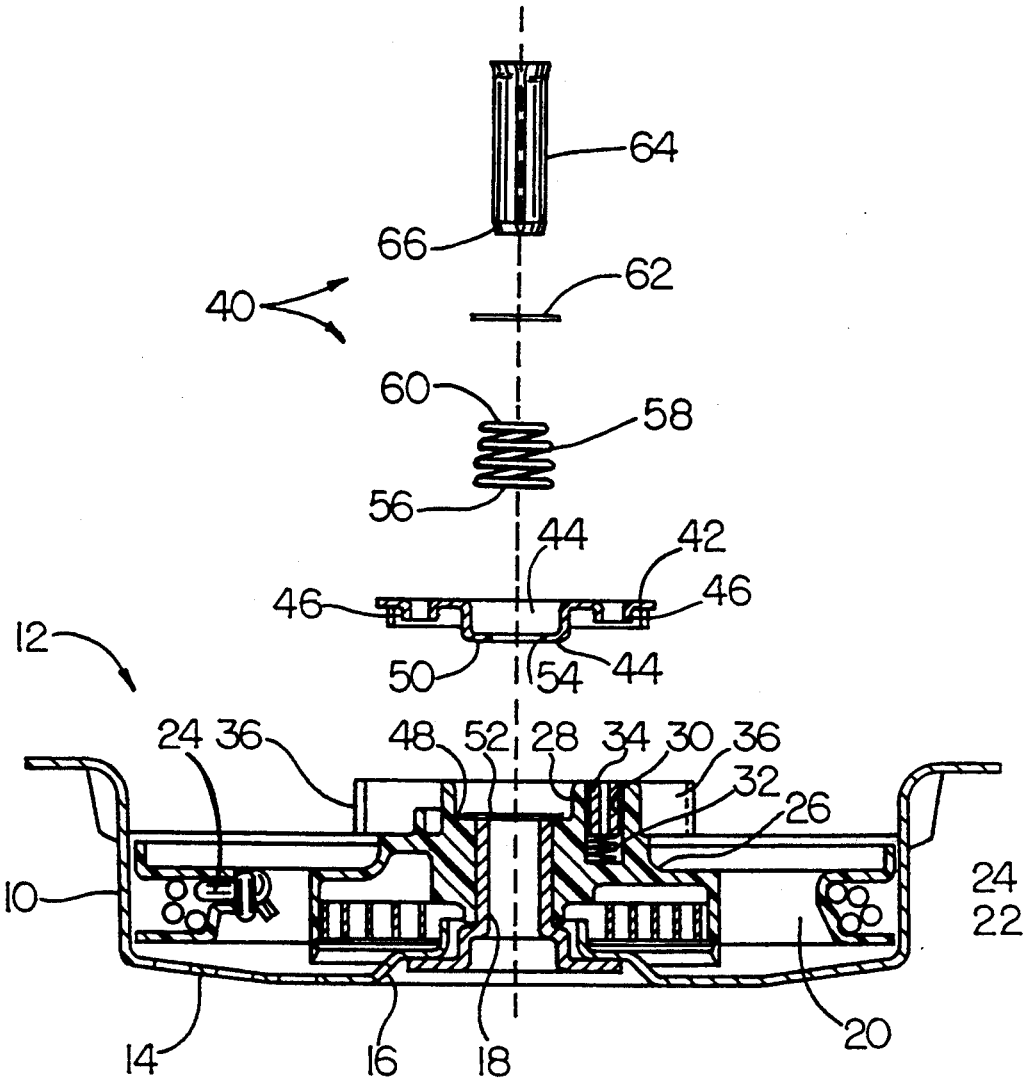
FIG. 4 PRIOR ART
FIG. 4 is an exploded view of the brake assembly, partly in side elevation and partly in section.
Figure 5:
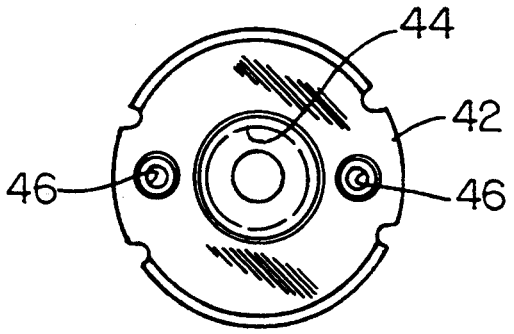
FIG. 5 PRIOR ART
FIG. 5 is a bottom view of a retainer portion of the brake assembly of FIG. 4.
Figure 6:
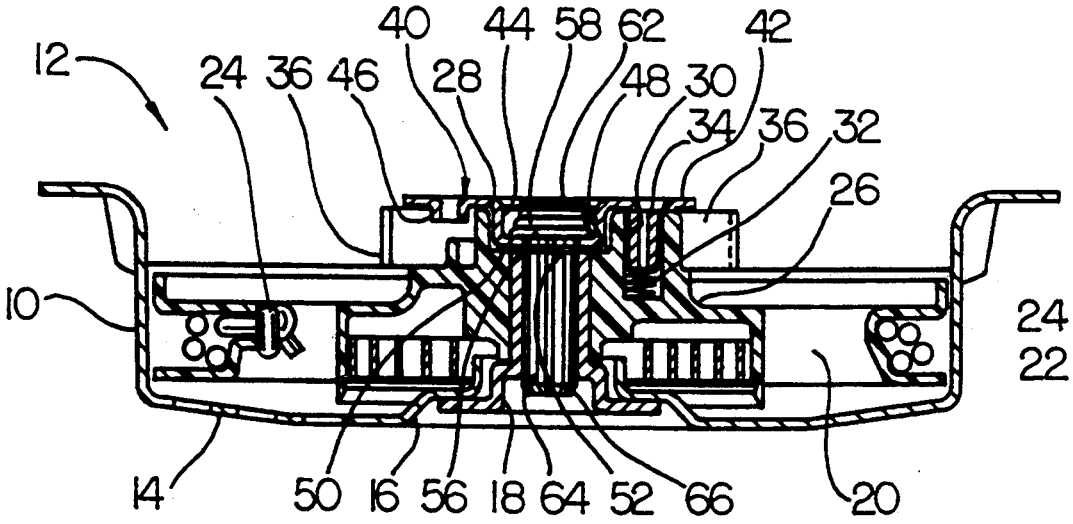
FIG. 6 PRIOR ART
FIG. 6 is a sectional view, similar to FIG. 2, but showing the brake assembly in combination with the housing and pulley portions.
Figure 7:
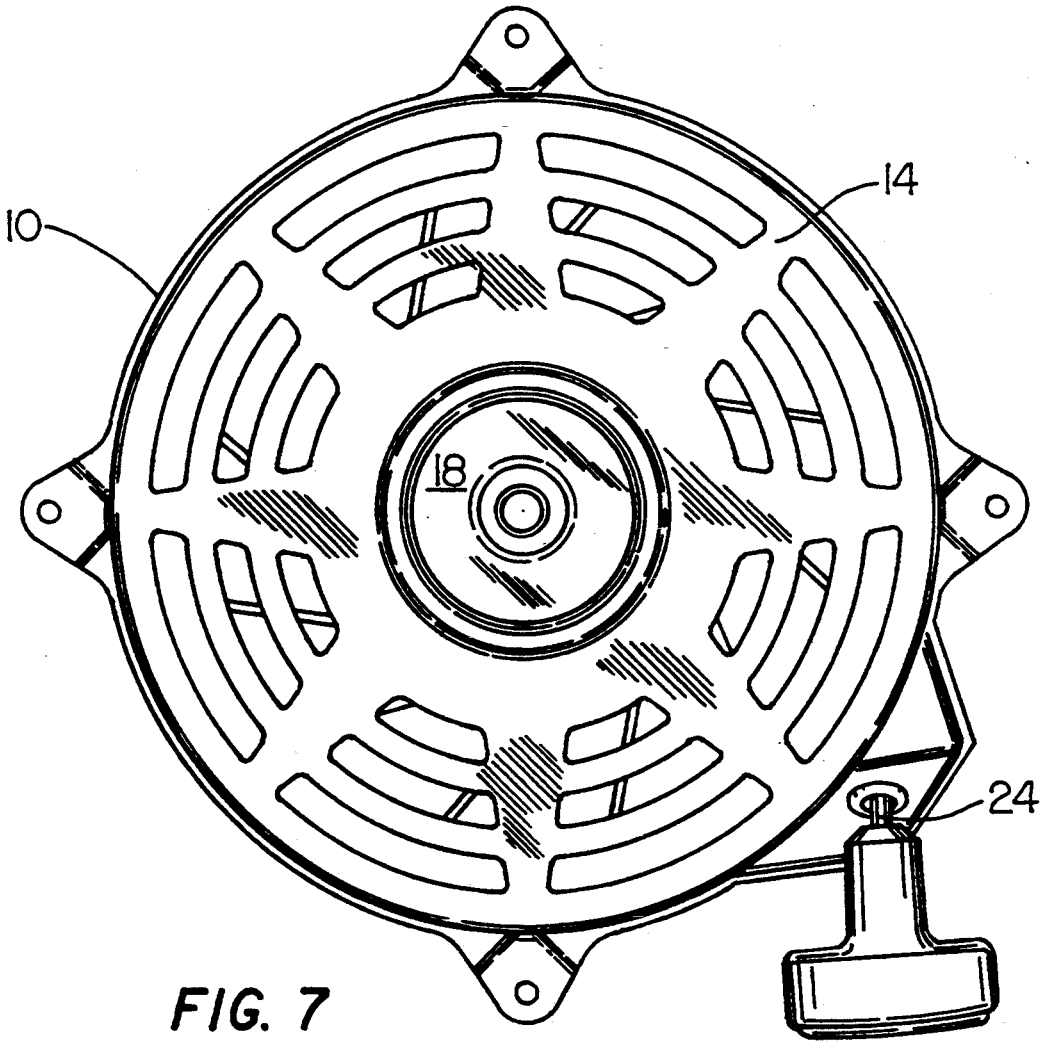
FIG. 7 PRIOR ART
FIG. 7 is a bottom view of the prior art starter of FIG. 6.
Figure 8:
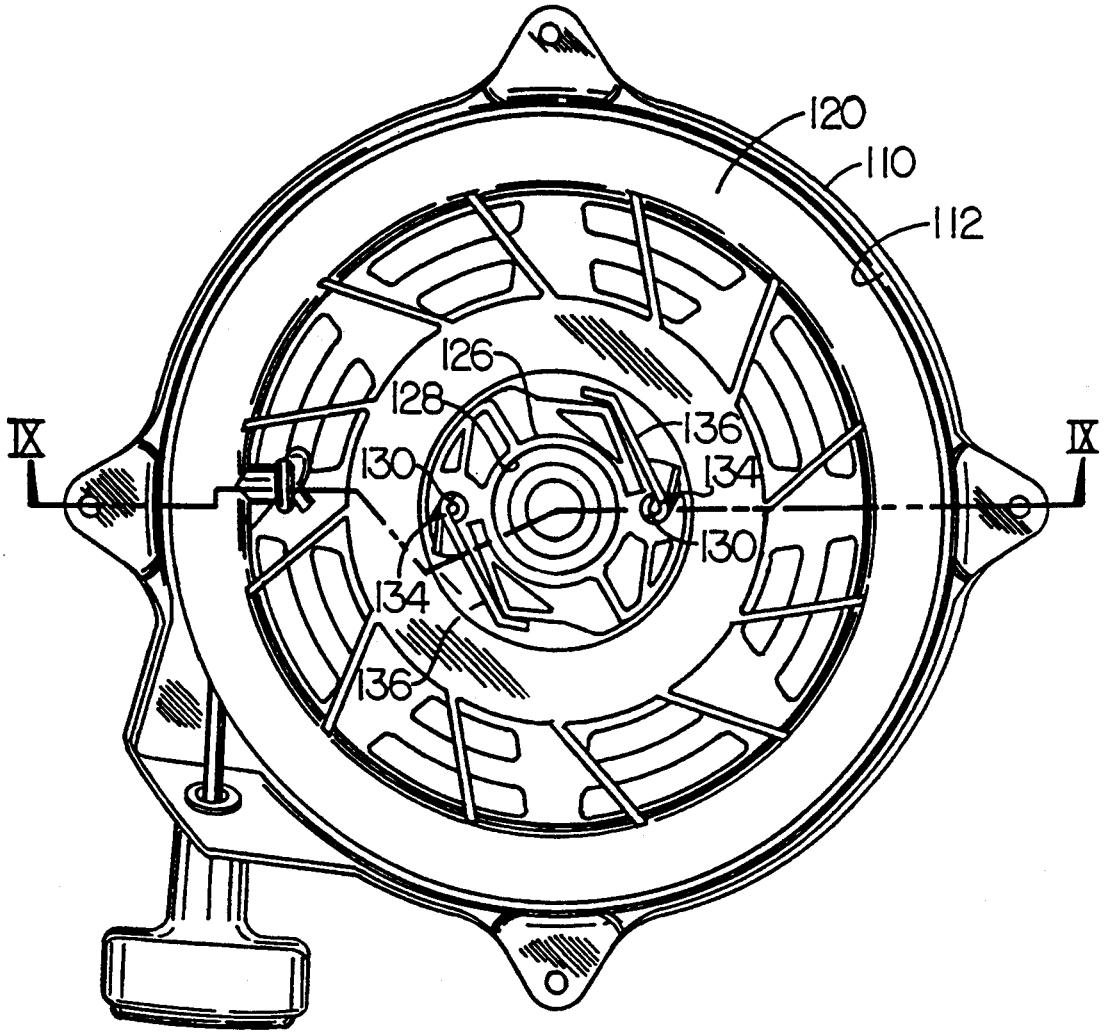
FIG. 8 is a top plan view of housing and pulley portions of one form of starter illustrative of an embodiment of the invention.
Figure 9:
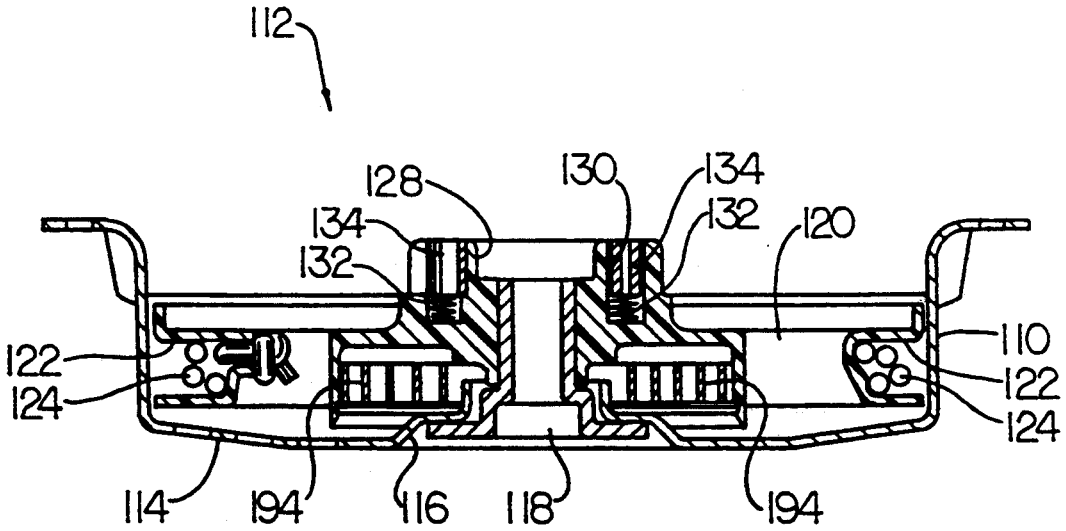
FIG. 9 is a sectional view taken along line IX—IX of FIG. 8.
Figure 10:
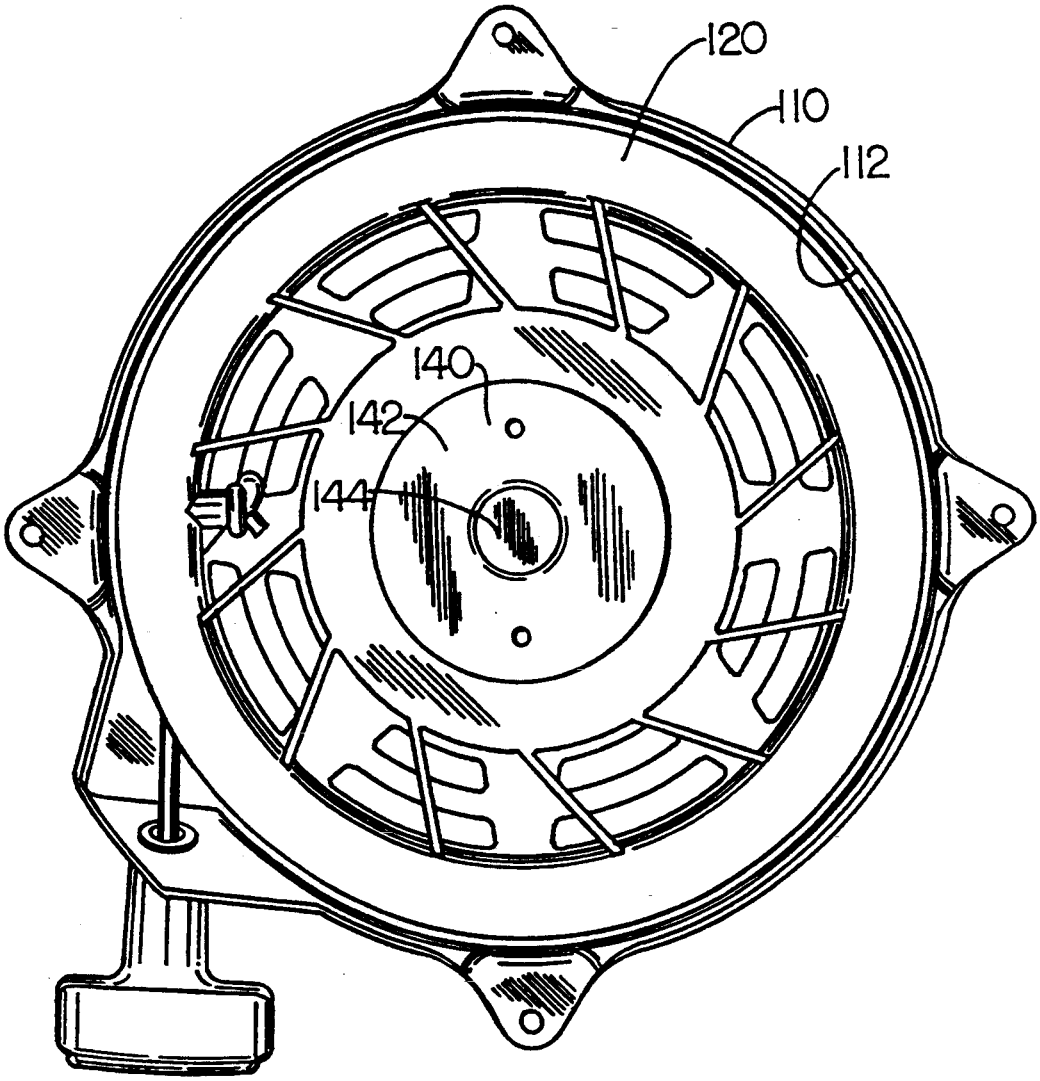
FIG. 10 is a top plan view of the starter of FIGS. 8 and 9 with a brake assembly illustrative of an embodiment of the invention, attached thereto.

Referring to FIGS. 8 and 9, it will be seen that illustrative housing and pulley portions of the illustrative starter include a housing 110 having an open side 112 and a substantially closed side 114. Centrally of the closed side 114 is an opening 116 in which is disposed a metal tubular center shaft 118. Rotatably mounted on the shaft 118 is a pulley 120 of a plastic material. The pulley 120 is provided with a peripheral trough 122 in which is wound a rope 124. The pulley 120 includes a hub portion 126 provided with a central recess 128 and two bores 130 outboard from, and on opposite sides of, the central recess 128. In each of the bores 130 there is disposed a coil spring 132 and base portion 134 of a pawl 136. The pawl base portions 134 are adapted to rotate in the bores 130, such that the pawls 136 may pivot outwardly and inwardly of the pulley hub portion 126.

Referring to FIGS. 10–15, it will be seen that a brake assembly 140, having resistance to rotation, includes a plastic retainer 142 having a central hub portion 144 complementary to the central recess 128 which is adapted to retain the hub portion 144. Extending from the retainer portion 142 are two protrusions 146 which are positioned so as to be engaged by the pawls 136.

Figure 11:
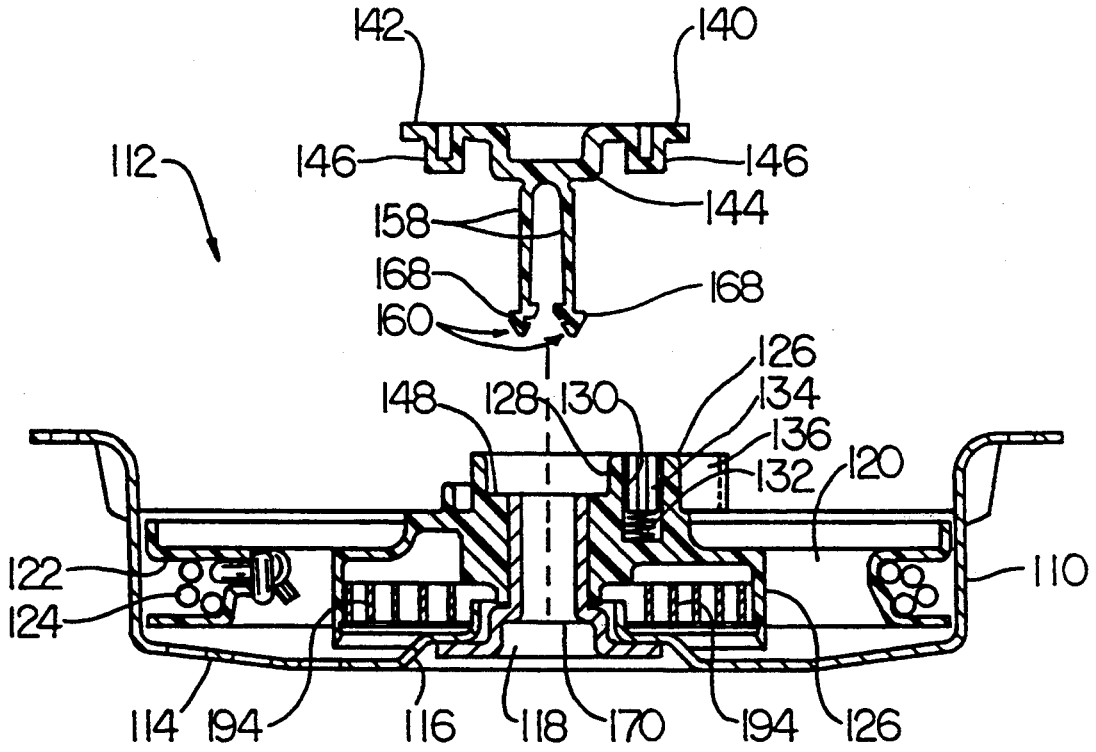
FIG. 11 is an exploded sectional view of the brake assembly in side elevational view.
Figure 12:
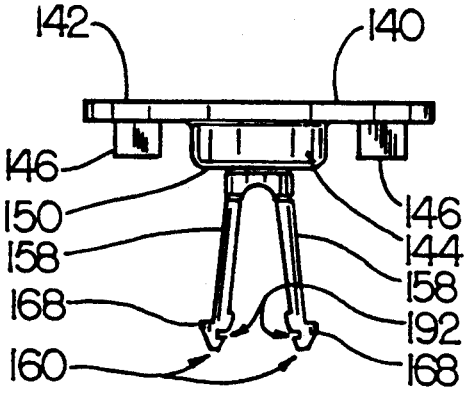
FIG. 12 is an elevational view of the brake assembly of FIG. 11 as molded.
Figure 13:
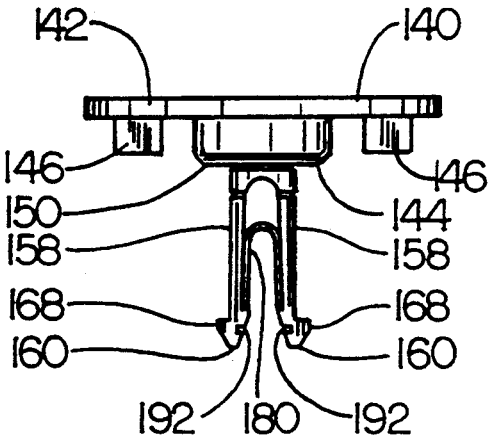
FIG. 13 is an elevational view of a portion of the brake assembly of FIG. 11 illustrative of an alternative embodiment of the invention.
Figure 14:
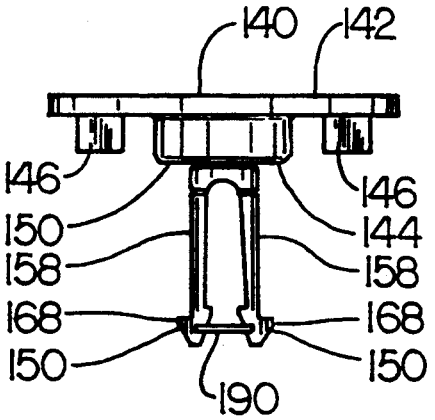
FIG. 14 is an elevational view of a portion of the brake assembly of FIG. 11, illustrative of another alternative embodiment of the invention.
Figure 16:
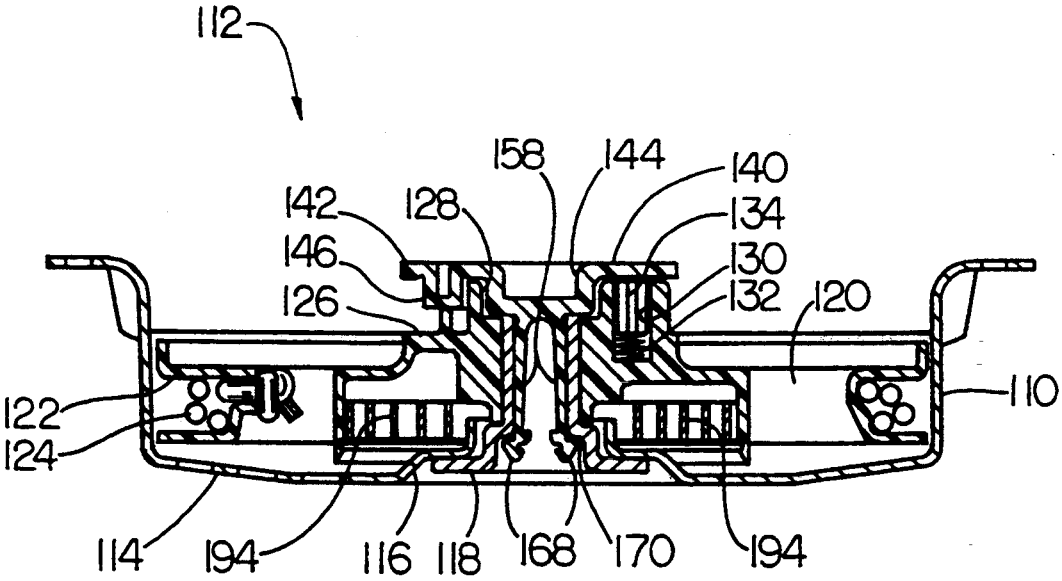
FIG. 16 is a sectional view, similar to FIG. 9, but showing the brake assembly in combination with the housing and pulley portions.
Figure 17:
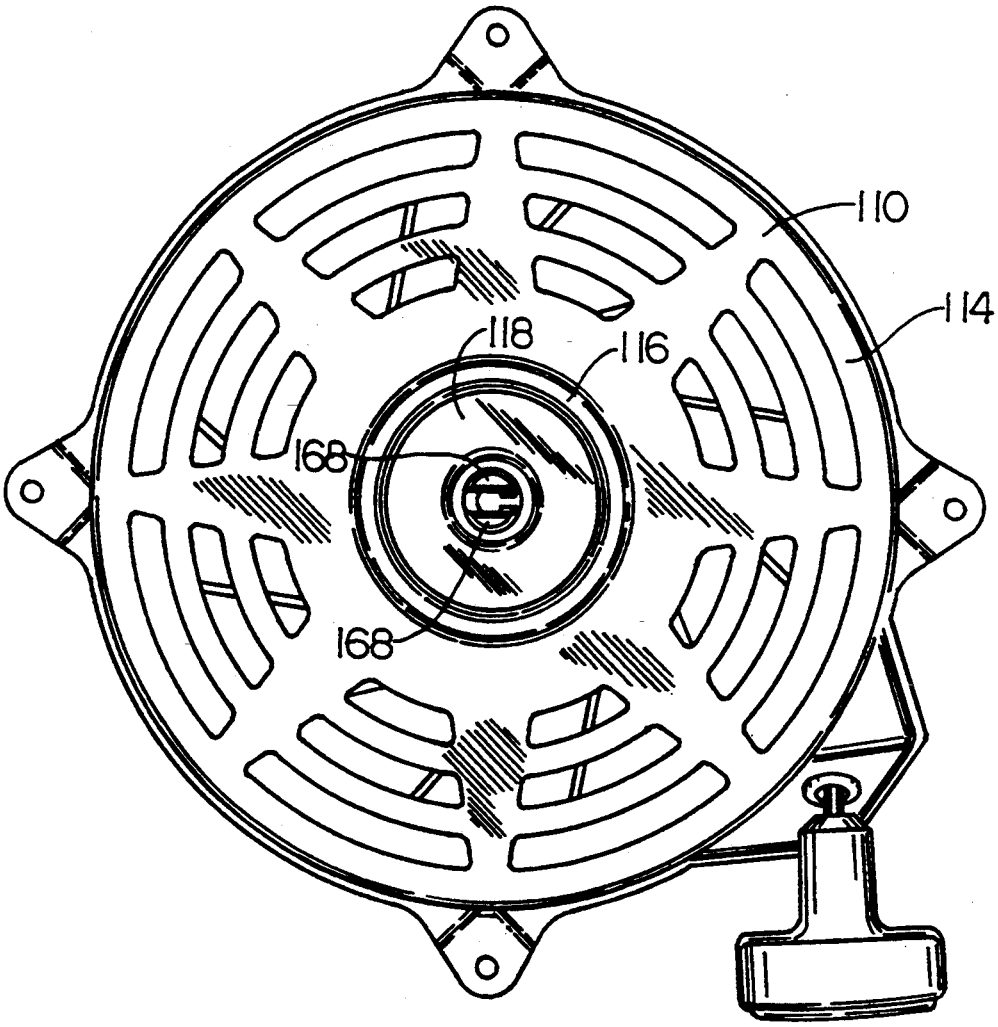
FIG. 17 is a bottom view of the starter of FIG. 16.

The retainer 142 is of a molded plastics material selected for its coefficient of friction, and molded integrally with the retainer 142 and extending from the hub portion 144 thereof, are at least two legs 158. The retainer 142 is molded with the legs 158 diverging (FIG. 12), such that the legs must be brought together for insertion into the tubular center shaft 118 (FIGS. 11 and 16). Free ends 160 of the legs 158 are configured as barbs 168 which, in assembly, snap beneath an internal annular flange 170 of the center shaft 118. The retainer legs 158 are continually biased outwardly by seeking return to their molded state, exercising tight engagement with the interior of the tubular center shaft 118, to brake turning of the retainer 142 and the pulley 120, and to keep the barbs 168 in locking engagement with the center shaft flange 170.

The degree of frictional resistance between the retainer legs 158 and the interior of the center shaft 118 is determined by selection of the plastics material from which the retainer is molded.

In instances in which fatigue of the retainer legs 158 is deemed of concern, the legs may be reinforced with a leaf spring, or torsional spring, 180 (FIG. 13) disposed between the legs 158, urging the legs 158 outwardly against the interior walls of the tubular center shaft. To further reduce the possibility of the legs 158 parting from the center shaft 118, a ring lock 190 (FIGS. 14 and 15) may be inserted in grooves 192 in the barbs 168 at the free ends of the legs 158. The ring lock 190 may be a split-ring of wire-like construction.

Figure 15:
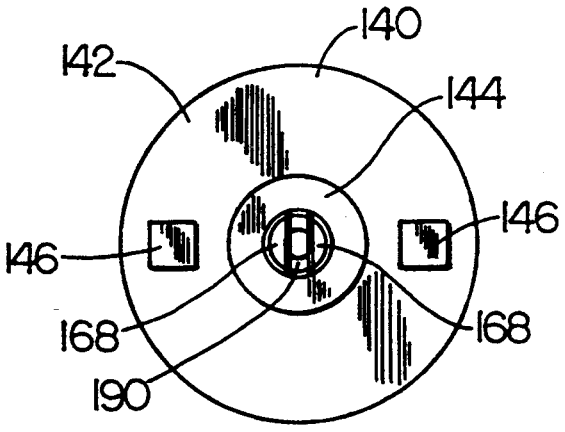
FIG. 15 is a bottom view of the device of FIG. 14.
Figure 15A:
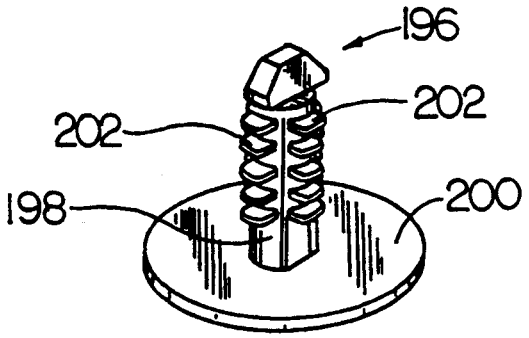
FIG. 15A is a perspective view of a plug member suitable for use in still another alternative embodiment of the invention.
Figure 15B:
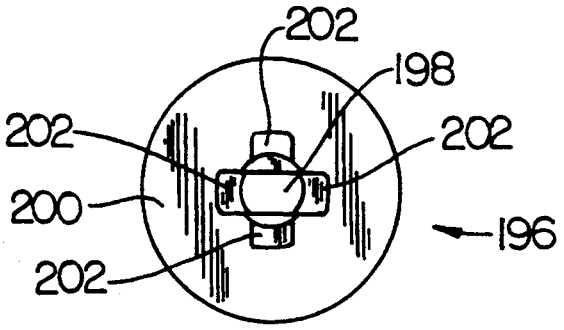
FIG. 15B is an end view of the plug member of FIG. 15A.
Figure 15C:
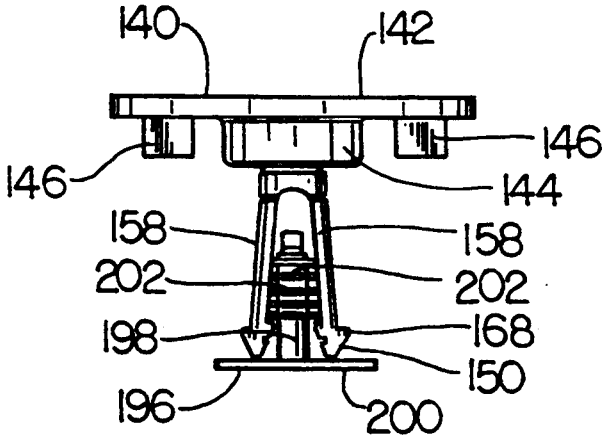
FIG. 15C is an elevational view of a portion of the brake assembly of FIG. 11, in combination with the plug member of FIG. 15A, illustrative of still another alternative embodiment of the invention.

Referring to FIGS. 15A–15C, it will be seen that, alternatively, to reduce the possibility of the legs 158 closing inwardly and parting from the center shaft, a plug member 196 may be pressed between the legs 158. The plug member 196 includes a post 198, a plate 200 at one end of the post 198, and radially extending teeth 202. The plug member 196 is of a rigid material, such as a rigid plastics material or metal.

In operation, an operator pulls the rope 124, which extends through the housing 110. As the rope 124 is pulled outwardly, the pulley 120 is caused to rotate on the center shaft 118. The retainer initially remains stationary because of the frictional engagement of the retainer 142 and the center shaft 118. As the pulley hub portion 126 rotates, the moving pawls 136 engage the retainer protrusions 146. The retainer 142 resists turning because of the frictional interengagement of the retainer legs 158 and tubular center shaft 118. Frictional resistance to turning may be increased by use of the aforementioned leaf spring 180 (FIG. 13), and/or the aforementioned ring lock 192 (FIGS. 14 and 15), or the afore-mentioned plug member 196 (FIGS. 15A–15C). The moving pawls 136 engaged with the retainer protrusions 146, pivoting (or deflecting) the pawls outwardly, cause the retainer thereafter to rotate with the pulley hub portion 126. Upon completion of a pulling stroke, a coil spring 194 (FIGS. 9, 11 and 16) disposed within the hub portion 126 operates to return the pulley to its original position by rotation of the pulley so as to re-wind the rope 124. During this recoil operation the pawls 136 retract.

The manner in which turning of the pawls 136 effects turning of a hub, which turns an engine, is known and described in the afore-mentioned U.S. Pat. No. 4,970,998 to Rex A. Tyler.

It is to be understood that the present invention is by no means limited to the particular construction herein disclosed and/or shown in the drawings, but also comprises any modifications or equivalents within the scope of the claims.

Having thus described my invention, what I claim as new and desire to secure by Letters Patent of the United States is:

1. A starter assembly for engines, said starter comprising:

a housing;

a tubular center shaft fixed in a central opening in said housing, said center shaft having an annular flange therein;

a pulley rotatably mounted on said center shaft, said pulley having a central hub portion, pawls each pivotally mounted at one end on said pulley hub portion; and a retainer mounted over said hub portion, said retainer comprising a base portion, legs extending from said base portion;

said retainer having protrusions extending from said base portion toward said pulley hub portion and engageable by said pawls upon rotation of said pulley, whereby to cause said retainer to rotate with said pulley hub;

said legs of said retainer being biased radially outwardly from said retainer to exercise engagement with interior walls of said tubular center shaft, said engagement being operative to restrain said retainer from rotating freely about said center shaft; and turning means for rotating said pulley, wherein upon rotation of said pulley, said pawls pivotally move into engagement with said retainer protrusions to cause said rotation of said retainer with said pulley against said restraint exercised by said retainer legs.

2. The starter assembly in accordance with claim 1, wherein said pulley hub portion is provided with a recess, and said retainer is provided with a retainer hub portion which is retained in said pulley hub portion recess, said legs of said retainer extending from said retainer hub portion into said tubular center shaft.

3. The starter assembly in accordance with claim 2, and further including reinforcing means disposed between said retainer legs and further biasing said legs against said interior walls of said tubular center shaft.

4. The starter assembly in accordance with claim 3, wherein each of said legs is provided with a groove on an internal wall thereof, and said reinforcing means comprises a ring, said grooves being adapted to receive and retain said ring for holding said legs in position against said interior walls of said tubular center shaft.

5. The starter assembly in accordance with claim 3, wherein said reinforcing means comprises a leaf spring.

6. The starter assembly in accordance with claim 3, wherein said reinforcing means comprises a plug member.

7. The starter assembly in accordance with claim 6 wherein said plug member comprises a post and a plate at one end of said post.

8. The starter assembly in accordance with claim 7 wherein said plug member further comprises teeth extending outwardly from said post.

9. The starter assembly in accordance with claim 2, wherein said retainer base portion, protrusions and legs are a unitary molded plastics member.

10. The starter assembly in accordance with claim 9, wherein each of said legs, at a free end thereof, is provided with an outwardly-extending flange which, in assembly, is adapted to snap beneath said center shaft internal annular flange, to connect said retainer to said center shaft.

11. The starter assembly in accordance with claim 10, wherein each of said leg free ends is provided with a barb defined in part by said outwardly-extending flange.

12. The starter assembly in accordance with claim 9, wherein said legs are molded such that said legs must be moved toward each other to be placed in said center shaft, the tendency of said legs to seek their molded disposition causing said bias of said legs radially outwardly and providing frictional resistance causing said restraint of said retainer from said rotation.

13. The starter assembly in accordance with claim 9 wherein said plastics is selected for its coefficient of friction, such that said retainer, when molded, exhibits a selected frictional characteristic.

* * * * *